US007826938B2

(12) United States Patent
Kato et al.

(10) Patent No.: US 7,826,938 B2
(45) Date of Patent: Nov. 2, 2010

(54) SYSTEM FOR TRACKING RAILCARS IN A RAILROAD ENVIRONMENT

(75) Inventors: Mamoru Kato, Kanagawa (JP); Ajay Divakaran, Woburn, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 1349 days.

(21) Appl. No.: 11/316,034

(22) Filed: Dec. 22, 2005

(65) Prior Publication Data

US 2007/0146159 A1 Jun. 28, 2007

(51) Int. Cl.
*B61L 3/00* (2006.01)

(52) U.S. Cl. ..... 701/19; 235/439; 235/436; 246/70; 340/825.49

(58) Field of Classification Search ..... 701/19; 340/10.1, 10.3, 572.1, 825.49, 572.7; 246/122 R, 246/70; 235/492, 439, 436, 440; *B61L 3/00*
See application file for complete search history.

(56) References Cited

U.S. PATENT DOCUMENTS 6,179,252 B1 * 1/2001 Roop et al. ..... 246/293
6,377,877 B1 4/2002 Doner ..... 701/19
6,511,023 B2 1/2003 Harland ..... 246/122 R
6,637,703 B2 10/2003 Matheson et al. ..... 246/124
6,750,769 B1 * 6/2004 Smith ..... 340/572.1
6,980,100 B1 * 12/2005 Hammond ..... 340/505
7,295,108 B2 * 11/2007 Corrado et al. ..... 340/539.22
7,319,397 B2 * 1/2008 Chung et al. ..... 340/572.4
7,323,996 B2 * 1/2008 Mullins ..... 340/572.7
7,551,082 B2 * 6/2009 Vishik et al. ..... 340/572.1
2002/0084387 A1 * 7/2002 Matheson et al. ..... 246/124
2003/0183697 A1 * 10/2003 Porter ..... 235/492
2004/0068361 A1 * 4/2004 Cross et al. ..... 701/117
2005/0205719 A1 9/2005 Hendrickson et al. ... 246/122 R
2006/0065731 A1 * 3/2006 Powell et al. ..... 235/451
2006/0292984 A1 * 12/2006 Teate et al. ..... 455/41.2

* cited by examiner

*Primary Examiner*—Tuan C To
(74) *Attorney, Agent, or Firm*—Dirk Brinkman; Gene Vinokur

(57) ABSTRACT

A system determines real-time locations of railcars in a railroad environment. Railcars are equipped with at least four RFID tags. A RFID reader at a fixed location at every track branch in the environment reads the RFID tags. Railcar locations are updated for the railcars by determining the branches on which the railcars are located.

11 Claims, 5 Drawing Sheets

100

200

500

510 Server
501
Communication
interface
502 Railcar Location
Management system
503 Operation system
504 Resource Planning
system
Client Computers
530
530
550
Network
511
511
512
512
513
513
514
514
Sensors
AEI Readers
40
5
40
5
Handheld
AEI Readers
4
4
Locomotive
Cockpit
terminals
520
520
Inspection
machines
AEI Readers
150
5
150
5

SYSTEM FOR TRACKING RAILCARS IN A RAILROAD ENVIRONMENT

FIELD OF THE INVENTION

This invention relates generally to tracking railcars, and more particularly to real-time computer systems for tracking railcars in a rail yards and train depots.

BACKGROUND OF THE INVENTION

Rail yards and train depots perform important services such as freight distribution, railcar interchange and termination, and railcar inspection and maintenance. Therefore, management of railcars in the yards and depots is important for efficient railroad operation. Therefore, there is a need for a system that can provide real-time information on the location and status of railcars in the yards and depots.

U.S. Pat. No. 6,637,703 describes a system for tracking railcars by using an automated equipment identification (AEI) reader, which is also called as radio frequency identification (RFID) reader, and elevated cameras. Railcars in a yard are tracked by recognizing patterns in video images acquired by the cameras, and signals acquired by the readers. In general, it is known that pattern recognition is less accurate and less reliable for moving objects under changing lighting conditions.

U.S. Pat. No. 6,511,023 describes a system for tracking railcars by using AEI readers and wheel counting stations. A train traveling on a track is identified by the AEI readers. The wheel counting stations are located between the AEI readers to augment the identification locations. However, trains with the same number of wheels cannot be distinguished by that system. This is a particular problem in a rail yard or train depot where most trains are either relatively short, e.g., a single railcar, or the number of railcars in a train is changing dynamically.

U.S. Pat. No. 6,377,877 describes a system for tracking railcars by comparing a location and an itinerary of a railcar. The location is acquired from a GPS system. Because the railcar is not identified specifically, incorrect information can be collected.

U.S. Patent Application Publication 2005/0205719 describes a system for tracking a railcar equipped with an on-board communication system, including a location determining system and a transceiver for receiving and transmitting railcar data. The on-board system requires a power source and maintenance, increasing the cost of the system.

It is desired to provide a railcar tracking system and method that can accurately and reliably locate railcars in real-time in rail yards and train depots.

SUMMARY OF THE INVENTION

One embodiment of the present invention provides a railcar tracking system. Railcars are equipped with automated equipment identification (AEI) RFID tags. AEI readers are arranged in a railroad environment, e.g., a rail yard or train depot, particularly at entry and exit rail branches. An order in which the railcars are identified by the readers can be used to determine the location of trains.

Another embodiment of the invention distinguishes between single rail cars, and multiple railcars coupled as a train. Each railcar is equipped with at least four AEI RFID tags. The RFID tags are attached approximate to the four corners of the car, e.g., on each side of the railcar near the ends so that AEI readers on either side of the track can read the tags. The alignment and range of the AEI reader can be adjusted so that the tags on the rear of one railcar and the front of a following railcar can be read concurrently only if the two railcars are coupled.

Another embodiment of the invention provides a system and method for updating train information in real-time. Mobile AEI readers with computing and communication resources are used for synchronizing real operation and a database in a server. Users of the readers read the two RFID tags during coupling and uncoupling operations. The updated train information can be verified automatically when the train is passing a trackside AEI reader.

Another embodiment of the invention provides a decision support method for yard and depot operation using dynamic railcar allocation and scheduling. The method uses the real-time coupling information to allocate a block of coupled railcars to a train and to reduce operational cost of the coupling and uncoupling operations.

Another embodiment of the invention provides more accurate identification of railcars in a railroad environment where many AEI readers are close to each other because the tracks are spaced relatively close. The AEI readers are combined with optical components, such as infrared readers or cameras, and photo emitters. This way, a particular AEI reader can be activated by the optical components when the railcar is on a selected track.

DETAILED DESCRIPTION OF THE PREFERRED EMBODIMENT

Figure 1:
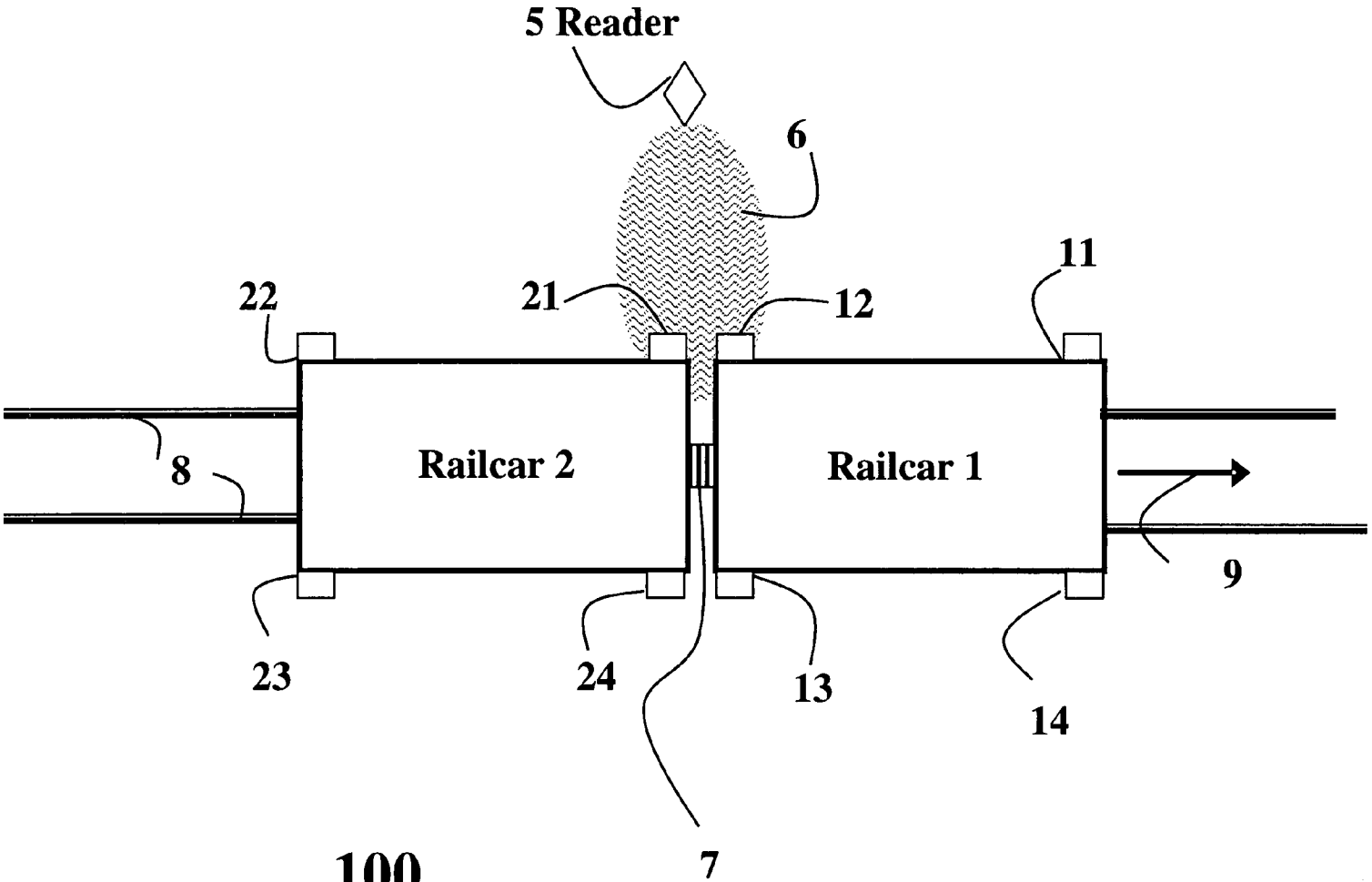
FIG. 1 is a top view of railroad environment including a train, an AEI reader and RFID tags according to an embodiment of the invention.

FIG. 1 shows a small portion 100 of a railroad environment, e.g., a rail yard or train depot. The environment includes an automated equipment identification (AEI) reader 5, AEI RFID tags 11-14 attached to a railcar 1, and AEI RFID tags 21-24 attached to a railcar 2. Every RFID tag includes a unique identification (ID) that can be read by the AEI reader 5. The RFID tags are placed near the corners of the railcars, e.g., on the sides and near the ends of the railcars. Multiple RFID tags are used to increase reliability of reading the RFID tags.

The AEI reader 5 is located adjacent to a track 8. The reader uses radio frequency (RF) signals 6. A range and direction of the RF signals 6 is adjusted so that the reader 5 can only read one RFID tag at a time, unless two adjacent railcars are coupled by a coupler 7. In this case, the reader 5 can concurrently read only two RFID tags on abutting corners of the two coupled railcars. When the railcars 1-2 move on the track in a particular direction 9, the reader 5 reads the RFID tags in a corresponding order.

Figure 2:
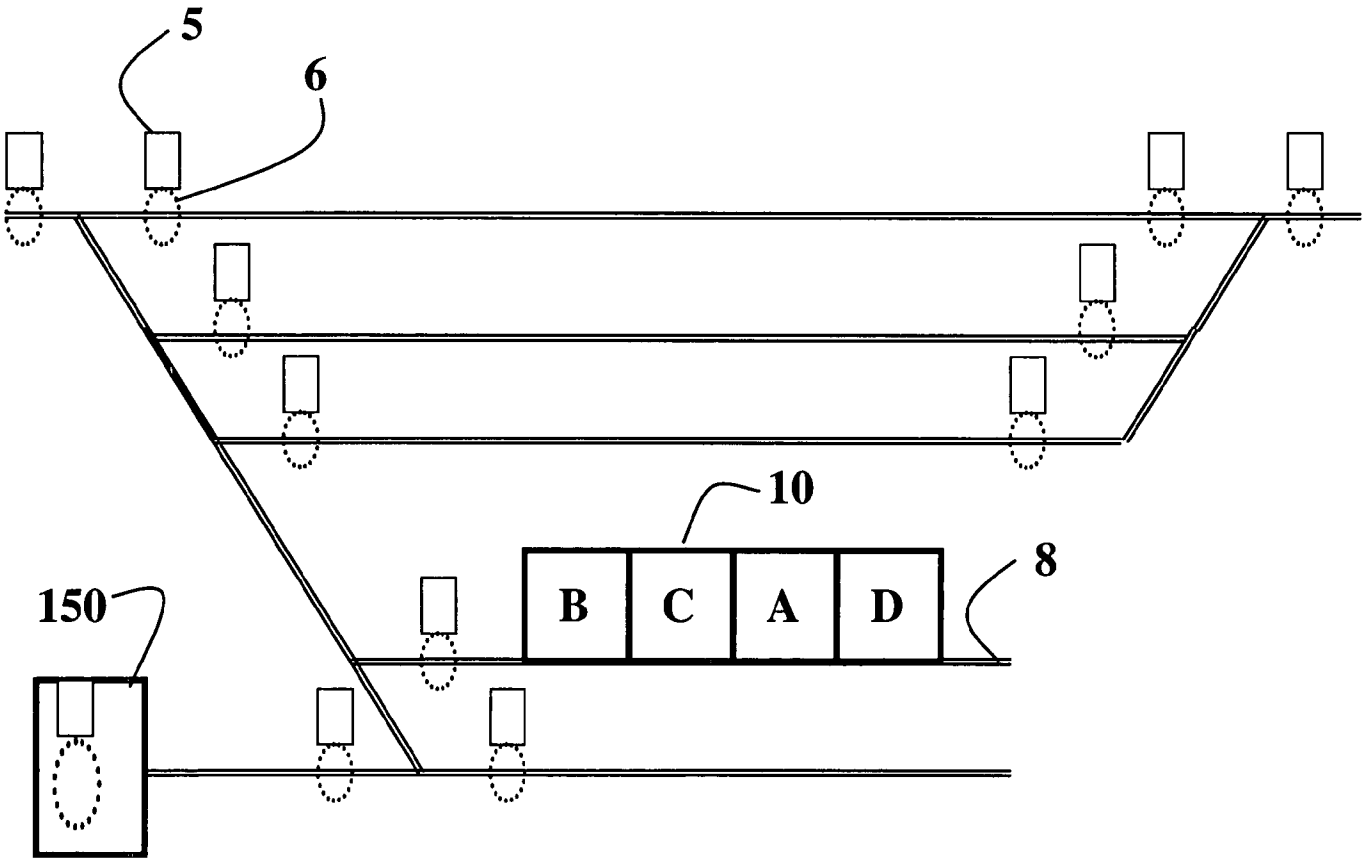
FIG. 2 is a top view of rail yard including a train, multiple AEI readers and RFID tags according to an embodiment of the invention.

FIG. 2 shows a larger portion 200 of the railroad environment. The environment includes readers 5 having RF ranges 6 adjacent to tracks. The readers are located at entry, exit, and branch points in the environment. A train 10 with cars A-D is located on track 8. Additional readers can be located for special purposes. One example is an inspection depot 150 where railcars can be inspected and inspection information can be associated with railcar identifications.

Figure 3:
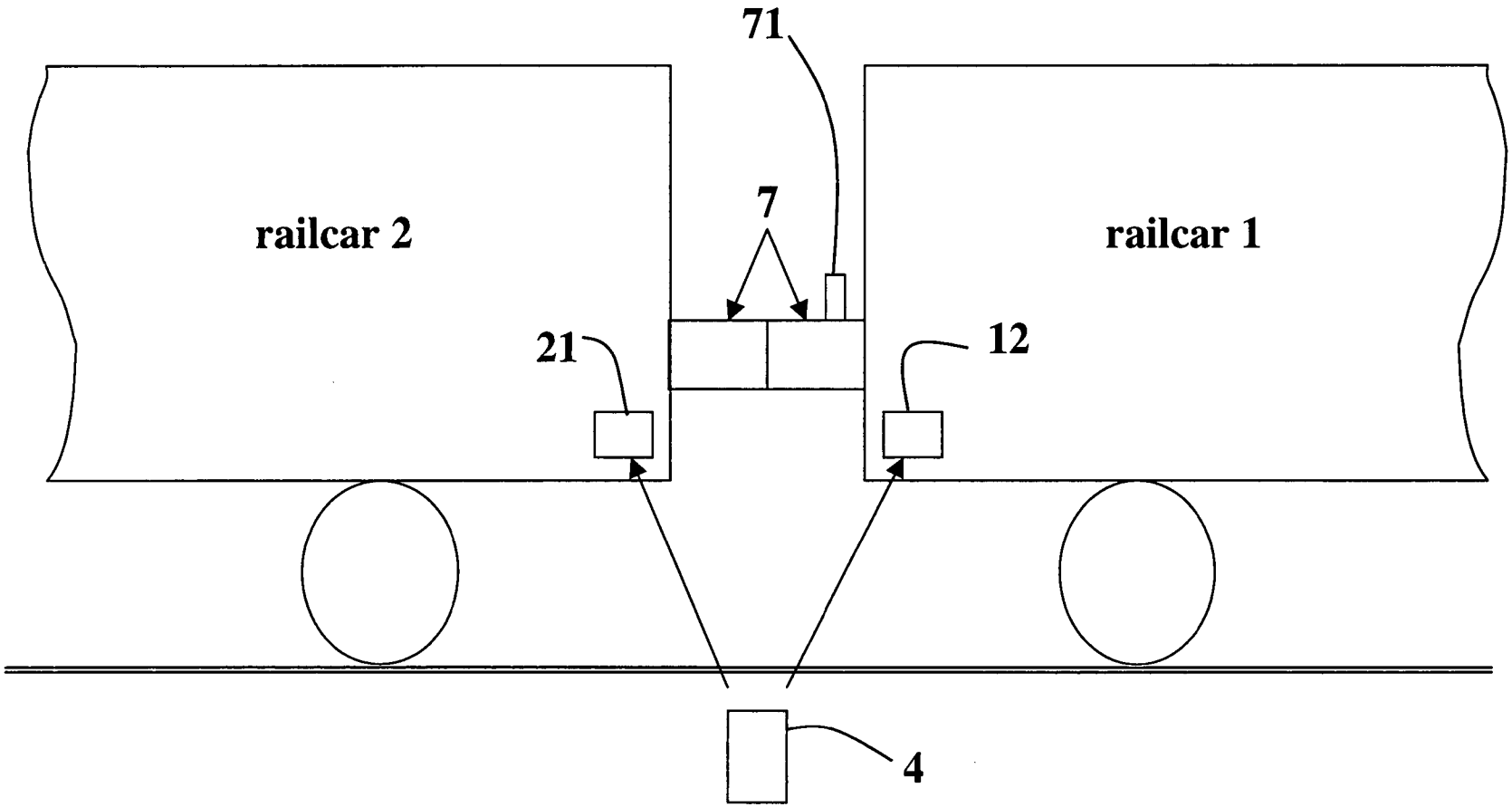
FIG. 3 is a side view of two railcars according to an embodiment of the invention.

FIG. 3 shows coupled railcars 1-2 and tags 12-21 according to the invention. Some railcars have couplers 7 and a key 71. The key 71 determines if the cars can be uncoupled. A mobile AEI reader 4 can be used to read and confirm the identification of the railcars involved in coupling/uncoupling operations. The identification can be exchanged with a database using a wireless connection.

One example of the operation flow is described below.

1. A central operator requests the uncoupling of railcars 1-2 via a computer system.
2. Locomotive and coupling crews are notified of the request.
3. The RFID tags 12 and 21 are read by the system to confirm the railcar locations.
4. The key 71 is removed.
5. The system sends an instruction to the crews to move a locomotive for the uncoupling.
6. The key 71 is reinserted.
7. The system completes the operation and updates the status.
8. The central operator can check all the procedures in real-time in an operation room.

Figure 4:
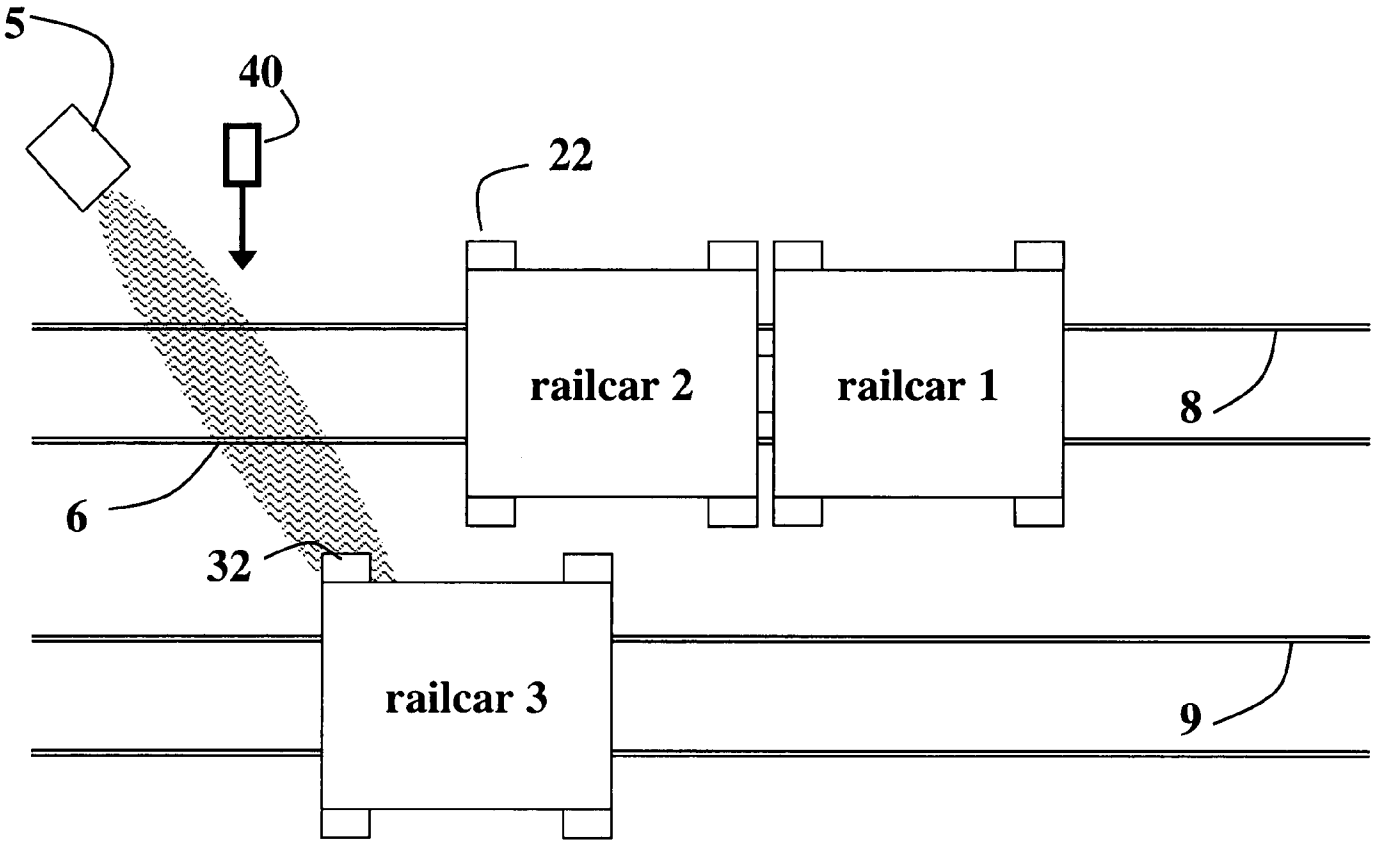
FIG. 4 is a top view of a railroad environment including trains on different tracks, an AEI reader, a sensor, and RFID tags according to an embodiment of the invention.

FIG. 4 shows an AEI reader 5 in close proximity to tracks 8-9. It is possible, due to the range 6 of the reader, that the reader can read RFID tag 32 on railcar 3 on track 9. This can cause errors in the system. According to an embodiment of the invention, the reader 5 can be associated with a sensor 40 to detect the railcar 3 on the correct track. The read IDs can be valid only while the sensor is detecting the railcar, or the reader can stop interrogating the RFID tags until the sensor detects the railcar. Thus, the system can prevent reading RFID tags on the wrong track. The sensor also helps to detect failure of reading the RFID tags on the correct track. The stopping interrogation of the reader can also reduce interference between readers substantially colocated in the environment. Thus the sensor can improve reliability of the AEI system in the yard/depot.

The sensor 40 can be an infrared-based distance sensor, or a camera and an image-processing unit.

Figure 5:
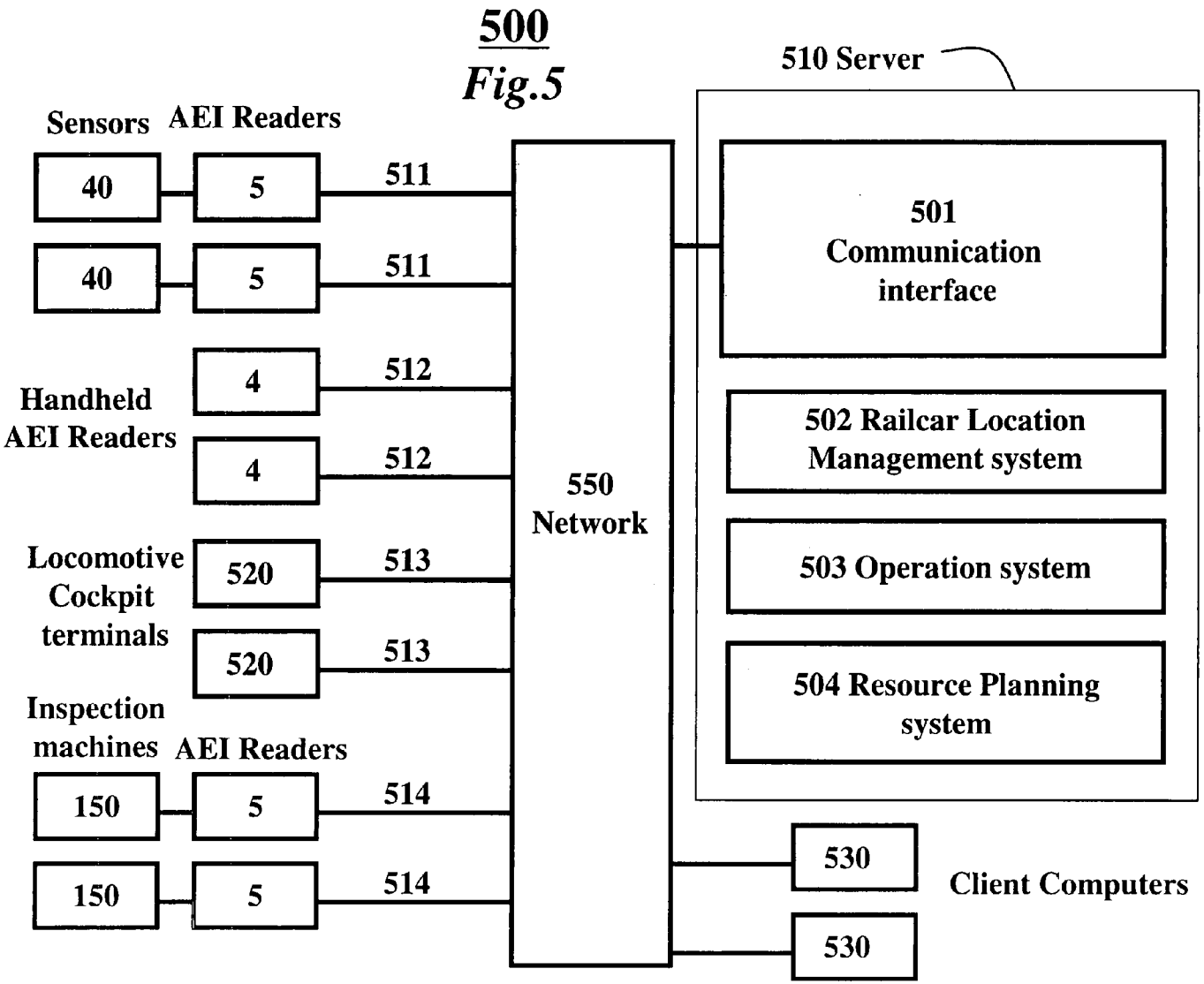
FIG. 5 is a block diagram of a railcar tracking system according to an embodiment of the invention.

FIG. 5 is a block diagram of a railcar tracking system 500 according to an embodiment of the invention. A server 510 can be located in a central or distributed operation room. Components of the server 510 can include a communication interface 501, a railcar location management system 502, an operation system 503, and a resource planning system 504. These components can be implemented in a single computer or multiple computers, which are connected by a network 550 via the communication interface 501. The network 550 can be implemented using conventional networking equipment, such as Ethernet and a wireless local area network (LAN).

Readers 5 are interfaced to the server through connections 511, which can be wired or wireless, and the network 510. Sensors 40 can be connected to readers 5, which usually have processors inside and can transmit additional information from the sensor as well as tag IDs to the server. Another embodiment can use integrated readers that embed the sensor so that the installation can be simpler. Mobile readers 4 are connected to the server via wireless connection 512. The readers 4 also include a display to show tag IDs, and associated information and commands from the system, etc. The associated information can include a name, status, specification, instructions, location and image of the railcar so that the railcar can be identified.

Terminals 520 are installed in locomotive cockpits and are connected to the server via wireless connection 513. The terminals 520 can show commands and status sent from the system. Inspection machines 150 can be associated with collocated AEI readers 5. The inspection machines are connected via wireless connections 514. In another embodiment, the inspection machine can also have a direct communication to the server, and the result and tag ID are associated in the server. In another embodiment, the inspection machine and the AEI reader are integrated for easier installation. Client computers 530 can also be connected to the system to provide user interfaces. For example, an operator can see the current location and status of the railcars graphically using the railcar location management system, issue commands to the crew and the workers in the yard/depot using the operation system, and plan interactively the resource allocation using the resource planning system.

When IDs are read by a particular AEI reader 5 from the RFID tags on the railcars, the tag information is sent to the server 510. The communication interface 501 controls the data flow between AEI readers and application systems in the server. Pre-registered locations of the readers are added to the ID data and sent to the railcar location management system, which updates the location of identified railcars.

When there are two IDs in a single read event, those IDs are associated with coupled railcars. The railcar location management system can also manage the inspection status sent from the inspection machine and the reader.

The resource planning system 504 can use information in the location management system to allocate railcars optimally to trains, which are operated on by the operation system. The resource planning system can have an optimization method, which uses the coupling information in order to allocate a block of railcars to a train and to minimize a total cost including re-blocking cost. The optimization method can also consider the inspection status and schedule of each railcar as a constraint, so that a failed or not-yet-inspected railcar is not allocated to a train.

Because the location management system updates in real-time, the resource planning system can make use of the real-time information and update the resource plan in real-time, and thus the system can reduce the operation cost of the yard/depot and recover the operation flexibly from any accidents or failure.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A system for determining real-time locations of railcars in a railroad environment, comprising:

a plurality of railcars, each railcar including at least four RFID tags attached for railcar identification;

a RFID reader at a fixed location at every branch track in the environment to read an identification of the RFID tags; and means for updating locations of the plurality of railcars by determining the branches on which the railcars are located.

2. The system of claim 1, in which the four RFID tags are attached near four corners of each railcar on the sides and near the ends, and further comprising:

means for detecting two coupled railcars by reading concurrently two tags associated with the two railcars.

3. The system of claim 2, further comprising:

a plurality of mobile readers; and means for updating the coupling status by scanning manually the RFID tags attached to the railcars being coupled or decoupled during operation using the mobile readers.

4. The system of claim 3, further comprising:

a server configured to provide operation management for the environment;

a cockpit terminal in a locomotive to display commands for a crew from the operation management; and means for sending commands to the mobile RFID readers and the cockpit terminal, only after confirming an identification of a particular railcar is correct and a sequence inputted to the mobile reader and the cockpit terminal is correct.

5. The system of claim 3, further comprising:

a server configured to provide resource planning for the railroad environment, and the resource planning including an optimization method which uses real-time coupling status for minimizing operation cost.

6. The system of claim 1, further comprising:

a plurality of sensors for detecting the railcars targeted by the RFID readers which are associated with the sensors; and means for getting tag identifications only when the railcar on a targeted track is detected.

7. The system of claim 6, in which the RFID readers are configured to stop reading tags when the railcar on the targeted track is not detected by the sensors.

8. The system of claim 6, in which the sensors are infrared distance sensors.

9. The system of claim 6, in which the sensors comprise a camera and a processing unit for object detection.

10. The system of claim 1, further comprising:

a plurality of inspection machines for inspecting the railcar;

a plurality of RFID readers for identifying the railcars being inspected; and means for automatically recording inspection results with the identification.

11. The system of claim 10, further comprising:

a server for providing resource planning for the railroad environment; and the resource planning uses the real-time inspection status of each railcar in order to avoid allocating failed or uninspected railcars to trains.

* * * * *